US007731824B2

(12) United States Patent
Slaugenhaupt et al.

(10) Patent No.: US 7,731,824 B2
(45) Date of Patent: Jun. 8, 2010

(54) MEASURING DUCT OFFGAS TEMPERATURES TO IMPROVE ELECTROLYTIC CELL ENERGY EFFICIENCY

(75) Inventors: Michael Lewis Slaugenhaupt, Apollo, PA (US); Neal Richard Dando, Murrysville, PA (US); Gary Paul Tarcy, Murrysvile, PA (US)

(73) Assignee: Alcoa Inc., Pittsburgh, PA (US)

( * ) Notice: Subject to any disclaimer, the term of this patent is extended or adjusted under 35 U.S.C. 154(b) by 1058 days.

(21) Appl. No.: 11/383,632

(22) Filed: May 16, 2006

(65) Prior Publication Data

US 2006/0254925 A1 Nov. 16, 2006

Related U.S. Application Data

(63) Continuation of application No. 10/645,070, filed on Aug. 21, 2003, now Pat. No. 7,112,269.

(51) Int. Cl.
*C25C 3/06* (2006.01)
*C25C 3/14* (2006.01)
*C25C 3/20* (2006.01)

(52) U.S. Cl. ..... 204/247; 205/245

(58) Field of Classification Search ..... 204/247, 204/245

See application file for complete search history.

(56) References Cited

U.S. PATENT DOCUMENTS 3,977,950 A 8/1976 Tortil
4,210,513 A 7/1980 Mutschler et al.
4,518,475 A 5/1985 Sivilotti
4,592,812 A * 6/1986 Beck et al. ..... 205/376
4,668,350 A 5/1987 Desclaux et al.
4,668,352 A 5/1987 Duprat et al.

(Continued)

FOREIGN PATENT DOCUMENTS

CA 996056 8/1976

(Continued)

OTHER PUBLICATIONS

Slaugenhaupt, et al., " Effect of Open Holes in the Crust on Gaseous Fluoride Evolution From Pots" The Minerals, Metals & Materials Society, San Diego Conference, Mar. 2-6, 2003.

*Primary Examiner*—Patrick Ryan
*Assistant Examiner*—William T Leader
(74) *Attorney, Agent, or Firm*—Greenberg Traurig, LLP

(57) ABSTRACT

Methods and systems for controlling operating conditions of electrolytic cells are provided, particularly aluminum electrolytic cells. The method may includes the steps of measuring offgas temperature from the electrolytic cell, comparing the measured offgas temperature to a target offgas temperature, and completing a predetermined action in response to the comparing step. The predetermined action may include one or more of changing a feed rate of feed materials supplied to the electrolytic cell or inspecting a crust of the electrolytic cell for an undesired condition, such as a crust hole. The system may include an electrolytic cell adapted to contain a molten metal mixture, a hopper adapted to provide feed material to the electrolytic cell, a hood adapted to contain offgas from the electrolytic cell, an exhaust duct interconnected to the hood and containing a thermocouple for measuring offgas temperature, and a control panel for receiving temperature measurements from the thermocouple.

3 Claims, 1 Drawing Sheet

U.S. PATENT DOCUMENTS

| | | | |
|---|---|---|---|
| 5,288,383 | A | 2/1994 | Sparwald et al. |
| 5,456,808 | A | 10/1995 | Juric |
| 6,132,571 | A | 10/2000 | Bell |
| 6,220,748 | B1 | 4/2001 | Bates |
| 6,440,294 | B1 | 8/2002 | Cotton |
| 7,112,269 | B2 | 9/2006 | Slaugenhaupt et al. |
| 2005/0040047 | A1 | 2/2005 | Bruggeman et al. |

FOREIGN PATENT DOCUMENTS

| | | |
|---|---|---|
| EP | 0195142 | 9/1986 |
| FR | 2029493 | 10/1970 |

* cited by examiner

MEASURING DUCT OFFGAS TEMPERATURES TO IMPROVE ELECTROLYTIC CELL ENERGY EFFICIENCY

CROSS-REFERENCE TO RELATED APPLICATION

This application is a continuation of U.S. patent application Ser. No. 10/645,070 filed Aug. 21, 2003, entitled "Measuring Duct Offgas Temperatures to Improve Electrolytic Cell Energy Efficiency", now U.S. Pat. No. 7,112,269. The above patent application is hereby incorporated herein by reference in its entirety.

FIELD OF THE INVENTION

The present invention relates to controlling operations of aluminum production cells in order to improve energy efficiency and to reduce fluoride emissions.

BACKGROUND OF THE INVENTION

Production of aluminum by the Hall-Heroult process makes use of a cell having a chamber containing alumina dissolved in a molten cryolite electrolyte bath. It is standard practice to add aluminum fluoride regularly to the cryolite so that the $NaF/AlF_3$ mass ratio is maintained at about 0.70-1.20.

The cryolite bath is covered by a solid crust that is punctured regularly when molten aluminum is tapped from the cell. Increasing the area of the open crust holes results in more fluoride evolution from the smelting pot, thereby increasing load on the pot scrubber and the resulting smelter fluoride emission level.

Increasing the average area of open crust holes in a pot line also increases variations in the bath ratio, resulting in poorer cell performance. This occurs because the amount of fluoride evolved from individual pots fluctuates while each pot continues to receive a relatively constant supply of fluoride in reacted ore from the dry scrubber line, plus the same daily maintenance supply of aluminum fluoride. These factors make it desirable to quantify the effects of pot operating practices on fluoride evolution in order to prioritize various efforts to minimize fluoride evolution.

In the prior art some attempts have been made to control aluminum fluoride additions to smelting cells. However, the prior art attempts each suffer from one or more serious disadvantages making them less than entirely suitable for their intended purpose.

Desclaux et al. U.S. Pat. No. 4,668,350 issued May 26, 1987 represents an effort in the prior art to control the rate of addition of aluminum fluoride to a cryolite-based electrolyte in an aluminum production cell. The claimed method requires regular measurements of cell temperature, either directly or by means such as a thermocouple inserted in the side wall, or the floor, or in a cathode current collector in the cell floor.

A principal objective of the present invention is to provide a process for controlling additions of aluminum fluoride to individual aluminum electrolysis cells, thereby to improve energy efficiency.

A related objective of the invention is to provide a process for controlling inspections and repairs for crust holes in aluminum production cells so that such inspections and repairs are performed where and as needed.

A further objective of our invention is to reduce fluoride emissions from aluminum production cells having cryolite-based molten electrolytes.

Additional objectives and advantages of our invention will become apparent to persons skilled in the art from the following detailed description of some particularly preferred embodiments.

SUMMARY OF THE INVENTION

In accordance with the present invention there is provided an electrolytic cell wherein aluminum is produced by electrolysis of alumina dissolved in a molten salt bath. A preferred cell comprises a pot defining a chamber containing the molten electrolyte, a cathode, at least one anode contacting the electrolyte, and a solid crust above the electrolyte. The crust comprises solidified electrolyte and alumina, and may build up to a thickness of several inches.

The molten electrolyte comprises sodium fluoride and aluminum fluoride in a weight ratio of about 0.7-1.2, together with lesser amounts of magnesium fluoride and calcium fluoride. The molten electrolyte has a temperature of at least about 900° C., more preferably about 900-1050° C., such as from about 960-980° C. As reduction proceeds, a pad of molten aluminum settles on the cell bottom above the cathode.

In order to tap molten aluminum from the cell the crust is broken periodically, leaving a hole through which heat is lost from the electrolyte and fluorides are evolved into the chamber. Cell voltage is increased to compensate for the lost heat, thereby increasing power consumption. The solid crust must also be broken away to replace spent anodes.

Heat loss from the cell is reduced by repairing the crust holes. Crust hole repair may be effected by covering the holes with a loose mass of solid particles or by covering the holes with solid particles contained in a receptacle as described in Cotten U.S. Pat. No. 6,400,294, the disclosure of which is incorporated by reference. Solid particles suitable for crust repair include alumina, aluminum fluoride, cryolite, and mixtures thereof in varying proportions.

Pot lines of electrolytic cells for aluminum production are also provided with ducts for collecting fumes evolved by the cells. The evolved fumes contain aluminum fluoride, hydrogen fluoride, alumina, water, to name a few. In order to reduce fluoride emissions, the fumes are scrubbed in solid vessels containing smelting grade alumina that is later fed to the cells.

In accordance with our invention we determine a standard rate of addition of aluminum fluoride to each cell in a pot line, by measuring approximately the average aluminum fluoride requirement over a period of time. The standard rate of addition of aluminum fluoride may vary from time to time.

A target temperature is also established in a duct carrying offgas away from the cell chamber. The target temperature is preferably an ideal temperature as measured by means of a thermocouple located inside an offgas duct for each cell, and may vary from time to time. We also measure actual temperatures in each offgas duct periodically, by means of a thermocouple located inside the duct.

When the actual temperature in the offgas duct is greater than the target temperature, the crust may be inspected for crust holes. When a crust hole is observed, it is repaired. In addition, the actual rate of addition of aluminum fluoride is increased above the standard rate. When the actual temperature is less than the target temperature, the actual rate of aluminum fluoride addition to the cell is reduced below the standard rate. The steps of measuring actual offgas temperature, inspecting and repairing the crust, and varying the actual rate of aluminum fluoride addition either above or below the standard rate are repeated as often as necessary. When the measured offgas temperature is about equal to the target temperature, the rate of aluminum fluoride addition is unchanged.

We have discovered that maintaining pot heat balance in accordance with the invention minimizes energy requirements for operating an aluminum electrolysis cell.

DETAILED DESCRIPTION

Figure 1:
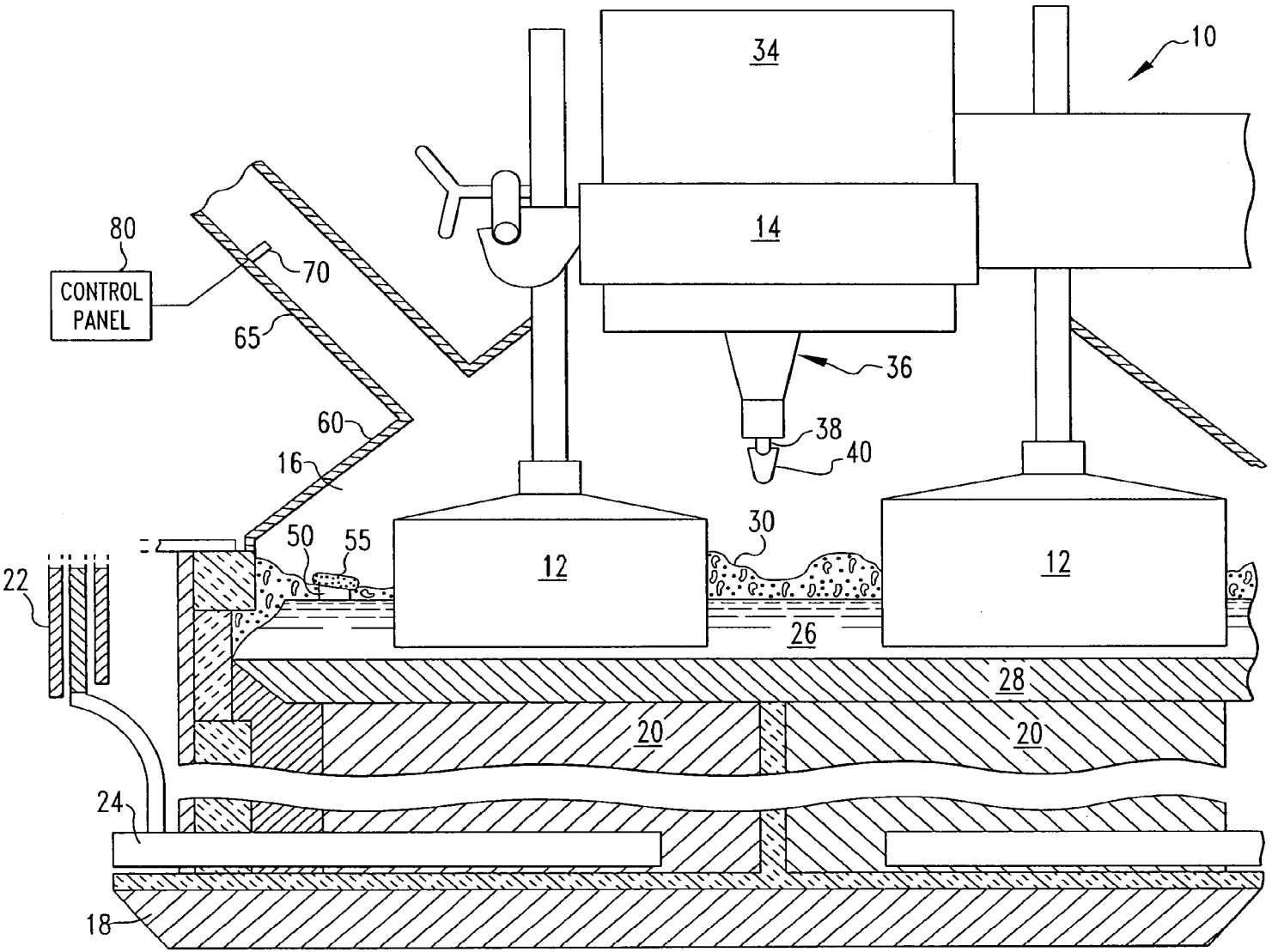
FIG. 1 is a cross-sectional view of an electrolytic cell for producing aluminum in accordance with the invention.

In FIG. 1 there is shown an electrolytic cell 10 for aluminum production, including carbon anodes 12 suspended by anode rods 13 from a bridge 14. The anodes 12 are situated within a cell chamber 16 lined with a layer of insulating material 18 upon which solid carbon cathode blocks 20 are positioned. The cathode blocks 20 are connected in an electrical circuit with an external bus 22 via steel collector bars 24 passing through the cathode blocks 20.

A molten cryolite electrolyte 26 containing dissolved alumina is maintained at approximately 950-960° C. within the chamber 16. As electrolytic reduction proceeds, a pad 28 of molten aluminum covers the cathode blocks 20. A layer of solid crust 30 forms above the molten electrolyte 26 surrounding the carbon anodes 12. The crust 30 is generally several inches thick.

The movable bridge 14 is adjustable vertically to enable the carbon anodes 12 to be elevated or lowered relative to the molten bath 26. An overhead hopper 34 supported above the anodes 12 is filled with alumina. Alumina from the hopper 34 is periodically added to the bath 26 as needed, through a feeder mechanism 36 including a steel rod 38 supporting a ceramic plugger foot 40. When alumina is added to the bath 26, the steel rod 38 and plugger foot 40 are thrust downwardly to punch a hole in the crust 30. An overhead conveyor 42 supplies alumina ore to the hopper 34 as needed.

Tapping molten aluminum from the metal pad 28 requires breaking the crust 30 to insert a vacuum tap (not shown). In a typical Hall-Heroult electrolytic cell, molten aluminum is tapped approximately every 24 hours. After the tap is removed a hole 50 remains in the crust 30 above the molten electrolyte 26. Holes left over from molten metal tapping typically have dimensions of about 12 in.×12 in. (30 cm.×30 cm.).

Holes 50 in the crust 30 may be repaired by covering the holes with masses of solid particles comprising alumina, crushed cryolite, or mixtures thereof. Alternatively, a hole 50 may be repaired by covering with a paper bag 55 filled with solid particles in accordance with the method disclosed in Cotten U.S. Pat. No. 6,440,294, the disclosure of which is incorporated by reference to the extent consistent with the present invention. The paper bag 55 is preferably double walled and is filled with approximately 20 lb. (9.1 kg.) of a mixture of smelting grade alumina (SGA) and crushed cryolite. A mixture of 10 lb. SGA and 10 lb. crushed cryolite is quite suitable.

Alumina and cryolite particles in the bag 55 are sintered into a porous mass by heat from the molten bath 26. The crust 30 is eventually restored to an unbroken, unitary mass.

Fumes escaping from holes 50 in the crust 30 are confined by a metal hood 60. The fumes, containing HF and various particulates, are channeled to an exhaust duct 65 containing a thermocouple 70 for measuring temperature of gases in the duct 65. Temperature measurements from the thermocouple 70 are sent to a central control panel 80 where temperature measurements from several cells 10 are monitored.

Cells exhibiting an actual exhaust duct temperature deviating from a target temperature are inspected for crust holes. If a crust hole is observed, the hole is repaired to reduce heat losses and escaping fumes. In addition, when the actual exhaust duct temperature is too high, the actual rate of addition of aluminum fluoride to the cell 10 is generally increased to an actual rate above the standard rate of addition. Accordingly, fluorides lost in vapors escaping through open holes 50 are replenished so that bath ratio deviations are limited. When the actual exhaust duct temperature is less than a target temperature, the actual rate of addition of aluminum fluoride to the bath 26 is lowered below the standard rate so that the sodium fluoride-aluminum fluoride bath ratio is maintained within desired limits.

Having described the presently preferred embodiments, it is to be understood that the invention may be otherwise embodied within the scope of the appended claims.

What is claimed is:

1. A system for controlling the operating conditions of at least one electrolytic cell, the system comprising:

a first electrolytic cell adapted to contain a molten metal mixture;

a hopper adapted to provide feed material to the first electrolytic cell;

a hood adapted to confine offgas from the first electrolytic cell;

an exhaust duct interconnected to the hood, the exhaust duct containing a temperature sensor for measuring temperature of the offgas; and a control panel for receiving temperature measurements from the temperature sensor, wherein the control panel is adapted to adjust the feed rate of the hopper in response to a temperature measurement from the temperature sensor.

2. The system of claim 1 further comprising:

a second electrolytic cell, wherein the control panel is adapted to control a feed rate of feed material to both the first and second electrolytic cells.

3. A system for controlling the operations of a plurality of electrolytic cells, the system comprising:

a plurality of electrolytic cells, each electrolytic cell comprising:

a molten mixture;

a hopper adapted to provide feed material to the electrolytic cell; and a hood comprising a duct for collecting offgas from the molten mixture, the duct comprising a temperature sensor for measuring the temperature of the offgas;

a control panel interconnected to each of plurality of electrolytic cells, the control panel being adapted to selectively adjust the feed rate of feed material to each of the plurality of electrolytic cells in response to a temperature measurement of the offgas from each of the plurality of electrolytic cells.

* * * * *